United States Patent [19]

Santora et al.

[11] 4,357,015

[45] Nov. 2, 1982

[54] ROULETTE GAME

[76] Inventors: Frank Santora, 2301 N. Grant Ave., Wilmington, Del. 19806; Robert L. Saissline, 3942 W. Northview, Phoenix, Ariz. 85021

[21] Appl. No.: 188,616

[22] Filed: Sep. 19, 1980

[51] Int. Cl.[3] ..... A63F 5/00

[52] U.S. Cl. ..... 273/142 E; 358/108; 273/DIG. 28

[58] Field of Search ..... 273/142 R, 142 A, 142 B, 273/142 C, 142 D, 142 E, 142 F, 142 G, 142 H, 142 HA, 142 J, 142 JA, 142 JB, 142 JC, 142 JD, 142 K, 138 A, DIG. 28; 358/108, 109

[56] References Cited

U.S. PATENT DOCUMENTS 3,283,070 11/1966 Prince ..... 358/108 X
3,810,627 5/1974 Levy ..... 273/138 A

FOREIGN PATENT DOCUMENTS 253581 9/1962 Australia ..... 358/108
6507044 12/1966 Netherlands ..... 273/142 R
252667 2/1970 U.S.S.R. ..... 358/108

*Primary Examiner*—Richard C. Pinkham
*Assistant Examiner*—Arnold W. Kramer
*Attorney, Agent, or Firm*—Mortenson & Uebler

[57] ABSTRACT

An improved roulette game is provided wherein a television camera, preferably a color camera, focuses on the spinning roulette wheel and rotates with it, thereby sending either a slow motion or still image of the roulette wheel to at least one television receiver to monitor the spinning roulette wheel and display the wheel to participants or to remote areas. The apparatus enables the viewer to watch the spinning wheel in slow or stop action, and the very instant the ball falls into a numbered slot it instantly appears on the monitor for all to see, thereby speeding play, enabling more spins of the wheel in any given time period, informing everyone of the winning number the instant the ball drops and generally making the game more spectacular and thrilling.

5 Claims, 7 Drawing Figures

2
4
6
8
9
10
11
12
16
18
20
24
26
28
30
34
35
36
1
2
3
0
00
2to1
4

ROULETTE GAME

BACKGROUND OF THE INVENTION

In the game of roulette, a wooden, precision gimballed wheel with the numbers 1 through 36 and "0" and "00" embossed on the rim and having individual slots corresponding to each number is used. The numbers are normally alternately red and black and the zeros are green.

The roulette wheel is normally located embedded in one end of a table, and on the table a betting layout is marked having the same numbers found on the wheel. The betting layout includes additional sections which may be used for side bets.

Prior to spinning the wheel, bets are placed by the players on chosen numbers, and the wheel is spun by the croupier. The croupier then drops or flips a small ivory ball, sending it spinning around the rim of the stationary rimmed wheel in the direction opposite the direction of wheel rotation. From this instant in time, the wheel spins and the ball travels the rim until the momentum of the ball is sufficiently slowed due to frictional and gravity forces that it falls from the rim, strikes one or more raised obstacles set into the wheel, and finally falls into one of the numbered slots. When the wheel has slowed sufficiently for the croupier to see which number is the winner, he places his marker on the winning number on the betting layout, collects the losing bets and distributes the payout of the winning bets. The time between the instant the croupier initially drops the ball to the instant he places his marker can be more than a minute.

During the time the wheel and ball are spinning, there is a lull in the action. Because of their seating location, the players can not see the spinning wheel clearly. The croupier, who stands adjacent the spinning wheel, is the only person at the roulette table who has a clear view of the wheel.

The number of bets that can be placed in any given time period is limited by the time delay during which ball and wheel are spinning. Bets can be placed at any time after the previous betting layout is cleared and all bets are paid. Betting stops when players hear the ball drop in the numbered slot. If the time period could be shortened between the instant the croupier flips the ball and the eventual settling of the ball into a numbered slot and slowing of the wheel to a speed slow enough to determine by eye which slot the ball is in, then the number of bets placed per unit time, e.g. number of bets per hour, would be increased. Thus, for those who enjoy roulette, their enjoyment would be increased. For the casino owners, who, on the basis of the law of averages are always winners, profits would increase.

The simplest bet in roulette is a one-number bet in which a chip is placed on a single number including "0" and "00" (in European casinos there is no "00"). Every bet loses if either "0" or "00" comes up if a player is not wagering on same. The payoff in a winning one-number bet is 35 to 1. Thus, on the average, since there are thirty-eight slots on the wheel (thirty-seven in Europe), for every thirty-eight spins the house wins thirty-seven times and loses once (thirty-six wins and one loss in thirty-seven spins in Europe). Since the payout is 35 to 1 on the one loss by the house, the house advantage, assuming a perfect unbiased wheel is 2/38ths or 5.26% (2.70% in Europe). The house "take" is thus the product of the total amount of bets, the number of spins per unit time, the time period of play, and 5.26%, again averaged over a relatively long period of time to eliminate random errors. It is thus clear that if the number of spins per unit time is increased, the house "take" is increased.

SUMMARY OF THE INVENTION

Apparatus is provided for viewing the ball in a game of roulette at the instant the ball drops into a numbered slot on the roulette wheel comprising: (a) a television camera mounted above a conventional roulette wheel, and being focused upon the wheel, (b) means for rotating the camera about an axis extending substantially vertically through the center of the wheel and enabling rotation of the camera about the axis at substantially the same rotational speed as the wheel during play of the game, and maintaining focus of the camera on the wheel during play of the game, and (c) means for transmitting the signals from the camera during rotation of camera and wheel to at least one stationary television receiving monitor in view of the players of the game.

When the roulette wheel is spun and play is begun, the camera rotating at substantially the same speed as the wheel causes a substantially still image of the wheel on the monitor, and the roulette ball appears on the monitor the instant that it drops into a numbered slot on the wheel.

Rotation of the camera focused upon the roulette wheel can be provided manually by the croupier or by a synchronous motor drive controlled by rheostat adjustment.

The television monitors can be located both at the roulette table itself to make the play of the participating players more exciting or they can be located in remote areas such as the hotel rooms in the casino, whereby remote persons could view the game. Electronic means such as are known in the prior art could be provided to enable the remote persons to bet and become players.

DETAILED DESCRIPTION OF THE INVENTION AND PREFERRED EMBODIMENTS WITH REFERENCE TO THE DRAWINGS

An improved roulette game is provided wherein a television camera, preferably a color camera, focuses on the spinning roulette wheel and rotates with it, thereby sending either a slow motion or still image of the roulette wheel to at least one television receiver to monitor the spining roulette wheel and display the wheel to participants or to remote areas. The apparatus enables the viewer to watch the spinning wheel in slow or stop action, and the very instant the ball falls into a numbered slot it instantly appears on the monitor for all to see, thereby speeding play, enabling more spins of the wheel in any given time period, informing everyone of the winning number the instant the ball drops and generally making the game more spectacular and thrilling.

Figure 1:
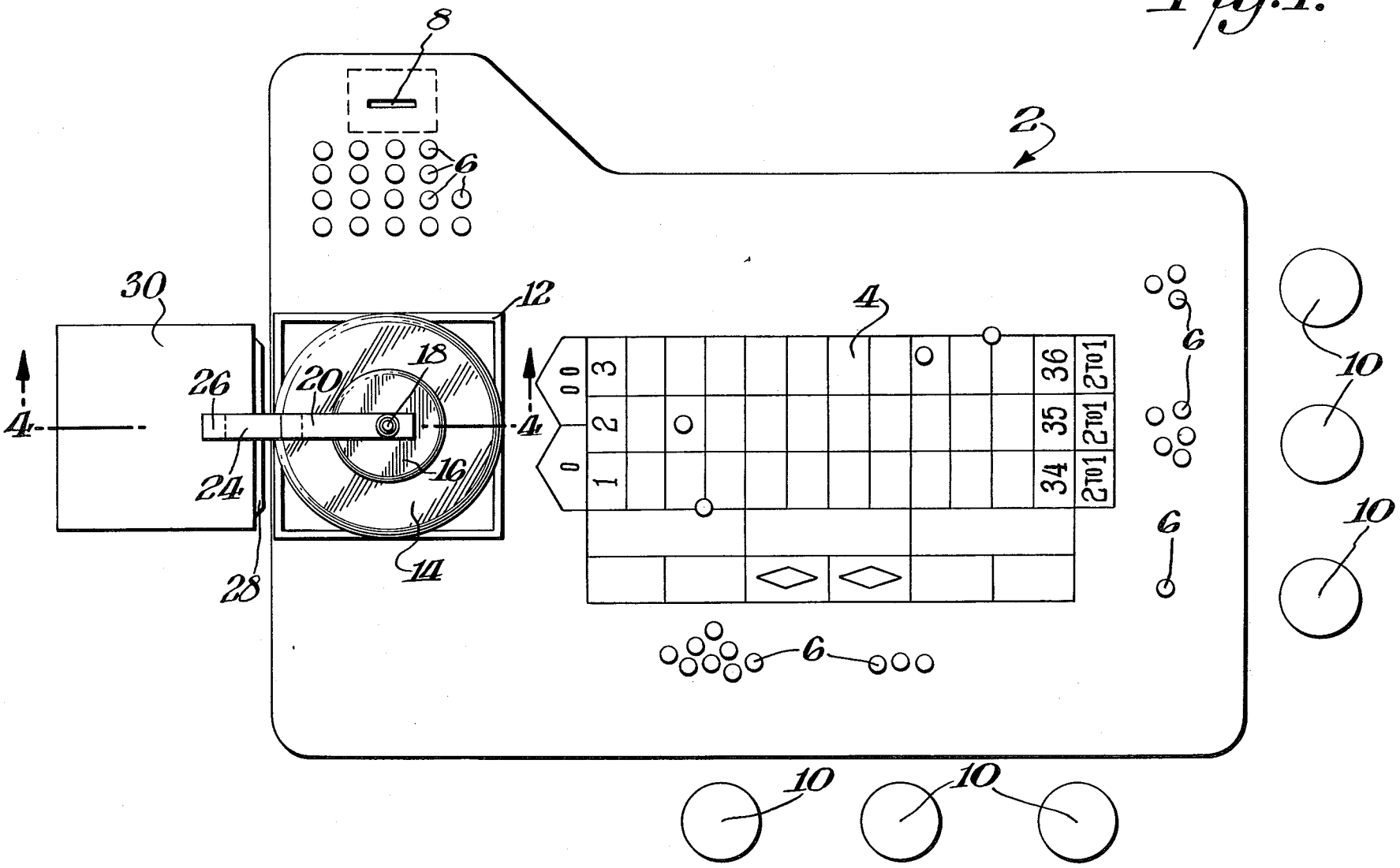
FIG. 1 is a top plan view of the apparatus of this invention located adjacent a conventional roulette table, also shown in top plan view.

The apparatus of this invention is best described with reference to the accompanying drawings wherein FIG. 1 shows a conventional roulette table 2 with the apparatus of this invention located adjacent thereto. On table 2 is shown the table betting layout 4, betting chips 6 located at players' positions 10 and at the croupier's position, and cash slot 8, also located at the croupier's position. Roulette wheel housing 12 in table 2 is shown located below wheel 14 which provides for camera rotation. Also shown in FIG. 1 are a housing 16 for the transmission circuitry for transmitting electrical signals from the television camera to the television monitor 28. Completing FIG. 1, top axle ball bearing assembly 18 is shown mounted in upper horizontal support bracket 20 for the electric housing 16, connected to horizontal support bracket 24 extending to cabinet 30 in which television receiver 28 is mounted.

Figure 2:
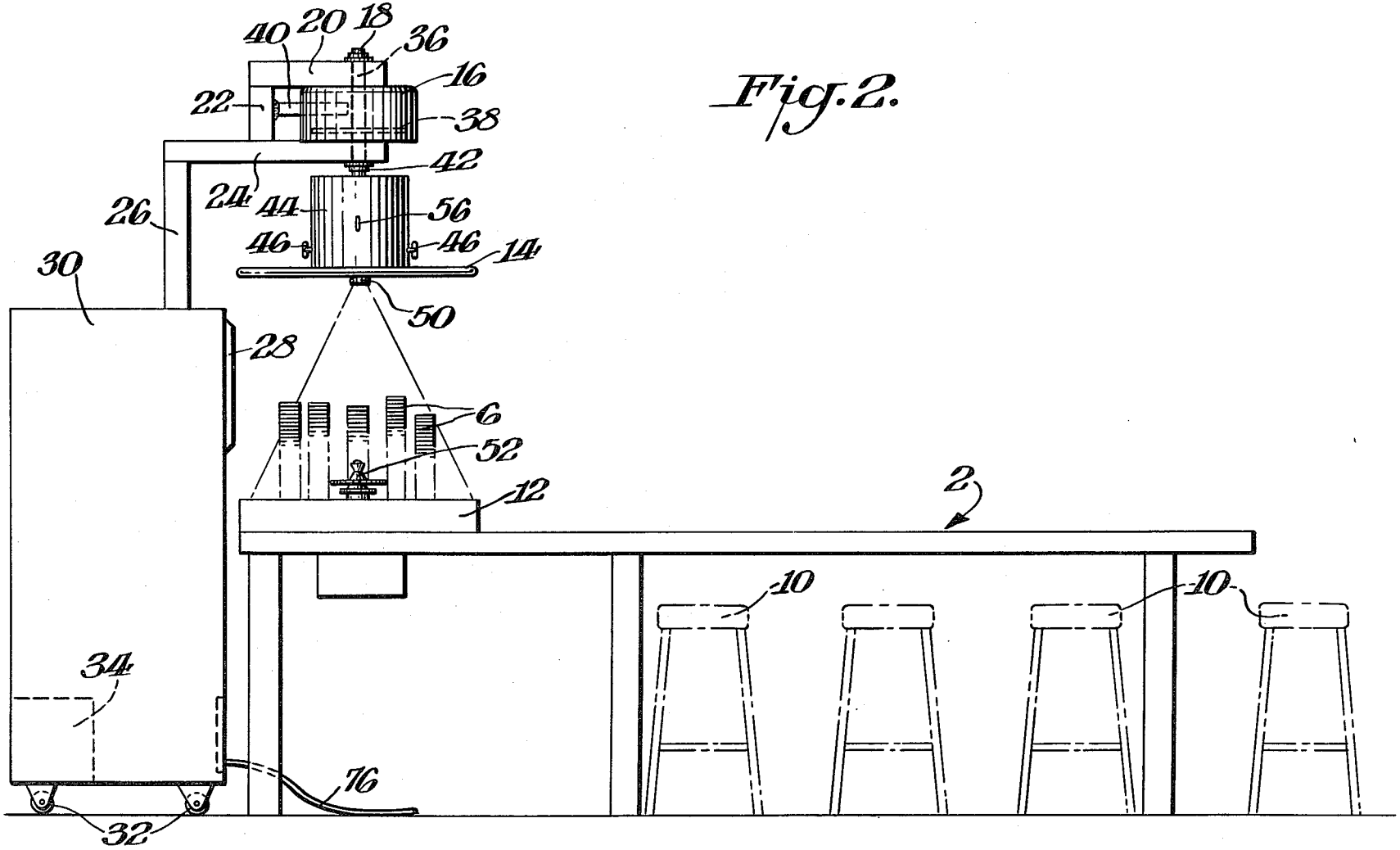
FIG. 2 is a side elevation of the apparatus of this invention and conventional roulette table and wheel.

FIG. 2 shows a side elevational view of the apparatus of this invention mounted adjacent roulette table 2. Players' seats 10 are shown arranged at table 2 and conventional roulette wheel 52 in wheel housing 12 is shown mounted in table 2. Chips 6 located at the croupier's position are shown for completeness.

Above the roulette wheel in FIG. 2 is shown television camera lens 50 protruding through the center of wheel 14. This camera lens is focused upon the roulette wheel 52. The television camera is mounted within camera housing 44 and is rotatably secured to the supporting structure as shown by bottom ball bearing assembly 42, axle 36 and upper ball bearing assembly 18, all secured to upper horizontal support 20, vertical support 22, horizontal support 24 and vertical support 26 which extends to and is affixed to television receiver cabinet 30. Counterweight 34 and locking wheel means 32 provide balance and ease of moving and locking the assembly. The supports 20, 22, 24 and 26 can be hollow, tubular aluminum and wiring from camera to monitor and from power supply to camera can be conveniently carried within these supports. Power to the system is shown supplied from a conventional a.c. power supply through cord 76.

In FIG. 2 and within the electronic transmission circuitry housing 16 are shown wheel 38 containing electric collector rings, the wheel 38 being affixed to axle 36 and rotating therewith. Support 40 is shown affixed to vertical assembly 22 and extending into the electronic assembly housing 16. Support 40 is used to hold carbon brushes or the like for transmitting the electronic signals from the rotating collector rings to the stationary supporting structure and thence to television monitor 28. Support 40 is conveniently constructed from a plastic such as nylon or polyethylene or like suitable nonconducting material.

Figure 3:
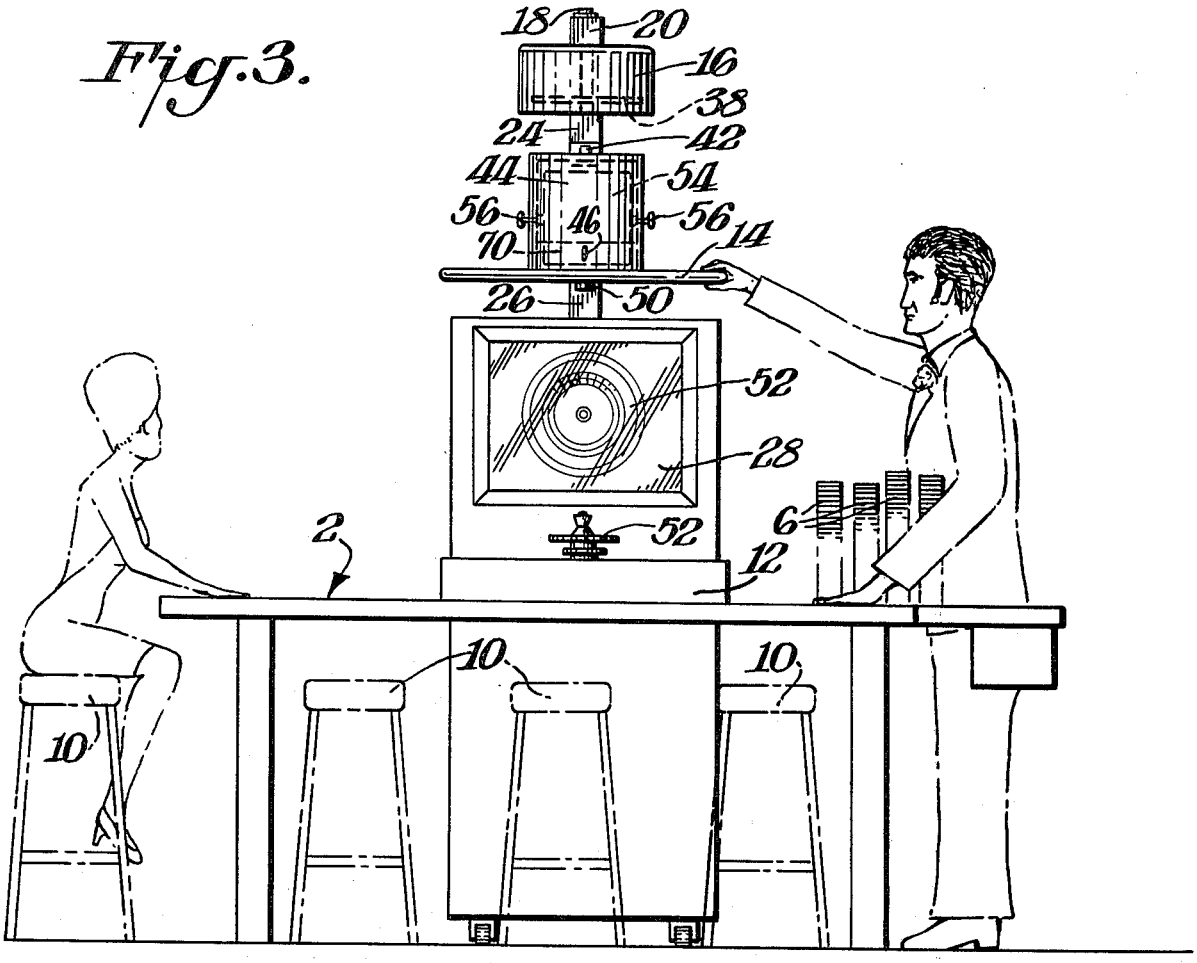
FIG. 3 is a front elevational view of the apparatus of this invention showing an image of the spinning roulette wheel being displayed on the television monitor in view of the player seated at the table and the croupier.

FIG. 3 shows, in front elevation, the apparatus of this invention in operation. A player is shown seated at one player position 10 and the croupier has just spun the roulette wheel 52 and the wheel 14 for providing rotation of the camera 54 at substantially the same rotational speed as roulette wheel 52. The croupier is shown making an adjustment of wheel 14 rotation to obtain substantially a still image of roulette wheel 52 as shown on television monitor 28. It will be appreciated and understood that as the roulette wheel 52 rotates and the roulette ball spins about the rim of wheel 52 in the opposite direction to the direction of rotation, the ball will not be visible on television monitor 28. However, the instant the ball drops into a number slot on wheel 52 it will suddenly appear on the screen at that instant, thereby providing additional thrill and excitement for the players of the game.

For completeness, also shown in FIG. 3 are housing 16 for the electronic transmission circuitry, top ball bearing assembly 18 for supporting the rotatable camera assembly, horizontal support 20, horizontal support 24, vertical support 26, electrical signal collector ring wheel 38, lower ball bearing assembly 42, camera housing 44, camera lens 50, camera 54 and set screws 56 for providing for affixing the camera securely within housing 44.

Figure 4:
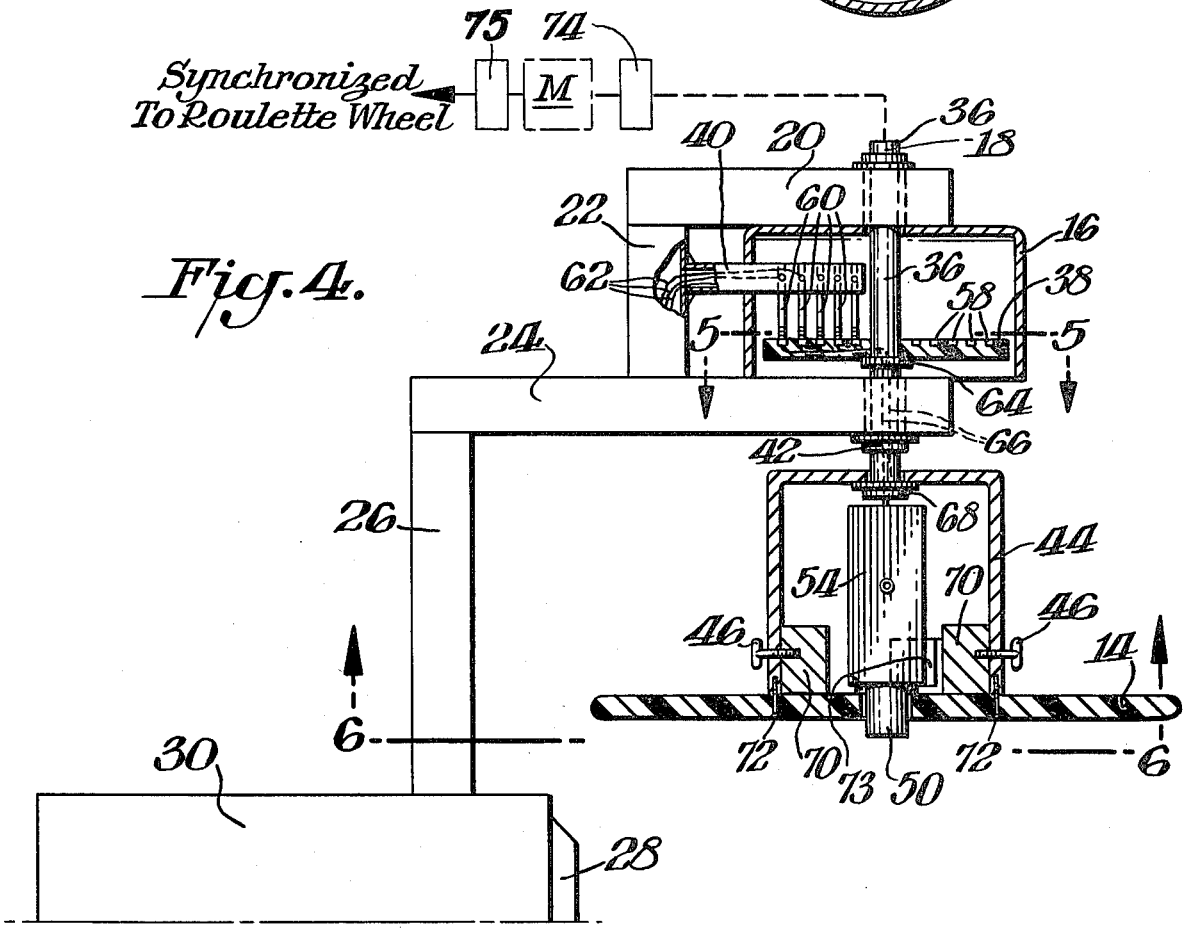
FIG. 4 is a side elevation, in part cross-section and in part broken away, of the apparatus of this invention taken along line 4—4 of FIG. 1.

FIG. 4 shows in detail the mechanisms involved in transmitting the images taken by the rotating camera into the fixed assembly supporting structure and thence to the television receiver. Camera lens 50 on camera 54 is focused, as stated previously, on the roulette wheel below. Camera 54 and the television receiver are both preferably color units. While camera 54, wheel 14 and housing 44 are all affixed to and rotating with axle 36 through ball bearing means 42 and 18 respectively, and this rotation is adjusted to substantially coincide with the rotational speed of the roulette wheel, a substantially still image of the roulette wheel is obtained by camera 54. The camera signals are transmitted via wiring 66 extending through the center of hollow axle 36 and terminating at collector rings 58, preferably copper, embedded in collector wheel 38. Collector wheel 38 is also preferably made of nylon or polyethylene or other like nonconducting plastic material. Each camera wire or power source wire has an individual collector ring 58 connected therewith. Electrical signals from the rotating collector rings 58 are transmitted to stationary brushes 60, one brush per ring, held in place by nonconducting support 40, each brush being connected to respective wire 62, shown in the broken away section in FIG. 4, each wire 62 being used to transmit a signal from the rotating camera to the stationary monitor or power supply or vice versa.

For completeness in describing FIG. 4, also shown therein are support members 20, 22, 24 and 26 containing wiring 62 and directing the wiring to cabinet 30, electronic assembly housing 16, retainer ring 64 for supporting collector ring wheel 38, retainer ring 68 for supporting and affixing camera 54 and housing 44 to axle 36, counterweights 70 affixed by set screws 46 to provide for balanced rotation of wheel 14 and the camera assembly and screws 72 for affixing wheel 14 to camera housing 44.

Also shown in FIG. 4 is an alternative embodiment for rotating the wheel 14 and camera assembly wherein a direct current motor drive M synchronized with the rotation of the roulette wheel is used to control the rotational speed of the camera by means of gear reducer 74, said motor drive being controlled by adjustment of a rheostat 75.

Figure 5:
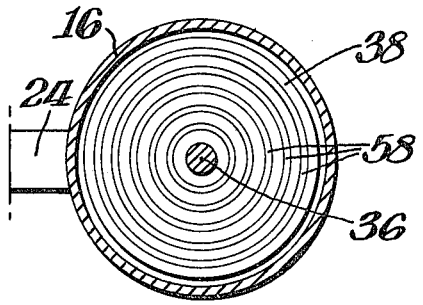
FIG. 5 is a top plan view of the collector ring wheel and collector rings of this invention taken along line 5—5 of FIG. 4.

FIG. 5 is taken along line 5—5 of FIG. 4 and shows housing 16 in which collector ring wheel 38 rotates, being affixed to rotating axle 36 and having collector rings 58 embedded therein.

Figure 6:
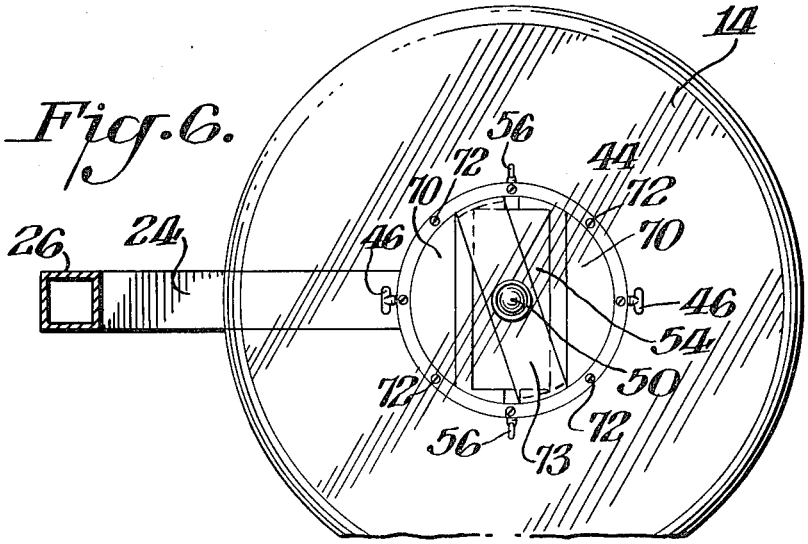
FIG. 6 is a bottom plan view of the wheel of this invention used to rotate the camera taken along line 6—6 of FIG. 4.

FIG. 6 is taken along line 6—6 of FIG. 4 and shows the wheel 14 for providing rotation of the camera assembly and the location of camera lens 50, camera 54, and camera set screws 56. Counterweights 70 and set screws 46 provide rotational balance for the system. Screws 72 are used to affix wheel 14, which preferably is of transparent plastic, to camera housing 44 as shown. Cross bracket 73 provides further bracing for camera 54. Supports 24 and 26 are provided for completeness.

Figure 7:
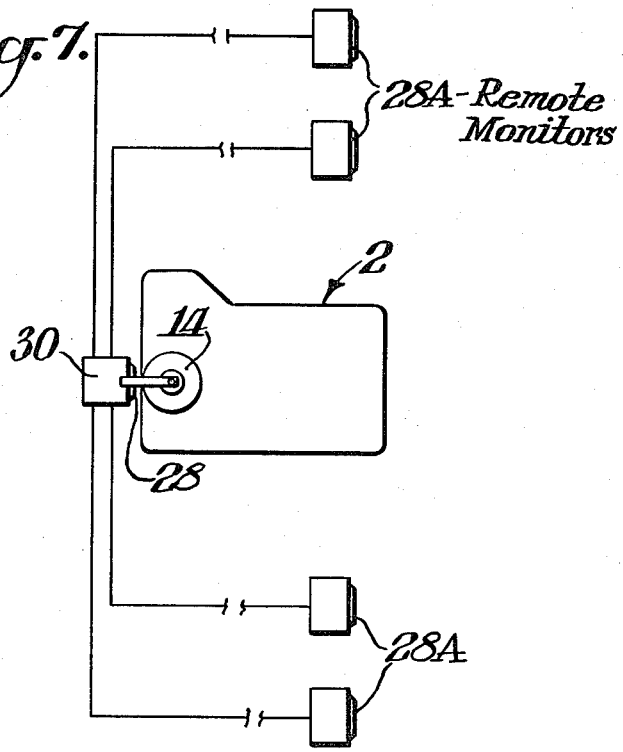
FIG. 7 is a top plan view of the apparatus of this invention showing television receivers located at areas remote from the roulette table and wheel, which receivers are displaying the action of the wheel.

FIG. 7 shows the invention herein wherein television monitors 28A are used at locations remote from roulette table 2 to view the action of the roulette wheel.

The invention as thus described provides apparatus for viewing the ball in an otherwise conventional game of roulette at the very instant the ball drops into a numbered slot in the roulette wheel during play of the game.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. Apparatus for viewing the ball in a game of roulette at the instant the ball drops into a numbered slot on the roulette wheel comprising:

(a) means mounting a television camera above a conventional roulette wheel, said camera being focused upon said wheel, (b) means for rotating said camera about an axis extending substantially vertically through the center of said wheel and enabling rotation of said camera about said axis at substantially the same rotational speed as said wheel during play of the game, and maintaining focus of the camera on said wheel during play of the game, and (c) means for transmitting the signals from said camera during rotation of camera and wheel to (d) at least one stationary television receiving monitor in view of the players of said game, whereby when the roulette wheel is spun and play is begun, said camera rotating at substantially the same speed as said wheel causes a substantially still image of said wheel on said monitor, and the roulette ball appears on said monitor the instant that it drops into a numbered slot on said wheel.

2. The apparatus of claim 1 wherein said camera is rotated at substantially the same rotational speed as said roulette wheel by manual adjustment by the croupier.

3. The apparatus of claim 1 wherein said means for rotating said camera comprises a direct current motor drive coupled to said wheel, through a gear reducer, said motor drive being controlled by adjustment of a rheostat.

4. The apparatus of claim 1 wherein a plurality of television monitors are employed at least one of which is located at a place remote from the roulette table.

5. The apparatus of claim 1 wherein said camera and said monitor are color camera and color monitor, respectively.

* * * * *